US010147410B2

(12) United States Patent
Ellingson

(10) Patent No.: US 10,147,410 B2
(45) Date of Patent: Dec. 4, 2018

(54) TOOT SUITE WHISTLE PACK

(71) Applicant: Thoroughbred Kids LLC, Dallas, TX (US)

(72) Inventor: Gordon Lehn Ellingson, Avondale Estates, GA (US)

(73) Assignee: THOROUGHBRED KIDS LLC, Dallas, TX (US)

( * ) Notice: Subject to any disclaimer, the term of this patent is extended or adjusted under 35 U.S.C. 154(b) by 0 days.

(21) Appl. No.: 15/913,522

(22) Filed: Mar. 6, 2018

(65) Prior Publication Data

US 2018/0197520 A1 Jul. 12, 2018

Related U.S. Application Data

(63) Continuation of application No. 13/848,712, filed on Mar. 21, 2013, now Pat. No. 9,940,918.
(Continued)

(51) Int. Cl.
*G10K 5/02* (2006.01)
*G08B 7/06* (2006.01)
(Continued)

(52) U.S. Cl.
CPC ..... *G10K 5/00* (2013.01); *A63B 71/02* (2013.01); *G08B 7/06* (2013.01)

(58) Field of Classification Search
CPC ... G10K 5/00; G10K 5/02; G08B 7/02; G08B 7/06; A63B 71/02
(Continued)

(56) References Cited

U.S. PATENT DOCUMENTS 945,311 A 1/1910 Fendrich
1,930,504 A 10/1933 Benjafield
(Continued)

FOREIGN PATENT DOCUMENTS

CN 201655290 U * 11/2010 ..... G10K 5/02
WO WO0005442 A1 2/2000
(Continued)

OTHER PUBLICATIONS

U.S. Appl. No. 13/848,712, filed Mar. 21, 2013.
(Continued)

*Primary Examiner* — R. A. Smith
(74) *Attorney, Agent, or Firm* — Winston & Strawn LLP

(57) ABSTRACT

A set of two or more whistles. Each whistle of the set sounds differently from each other based on a different type of sound or a different value of a characteristic of sound common to whistles of the set. Sound characteristics may include but not limited to pitch, quality, loudness, and/or duration. Each whistle in the set may be different in appearance from each other in the set. Appearance characteristics may include but not limited to color, numbering, design, light up features, size, and/or shape. Alternatively, the whistles in a set may have a common appearance characteristic, but each whistle may have its own value of the common appearance characteristic. Additional element(s) such as lanyards or mouthpieces may be added to whistles of a set to distinguish them from each other. The set of whistles may be included in a kit having a box for removably storing the whistles.

10 Claims, 6 Drawing Sheets

Table 1: Example of Differentiated Whistle Set with unique Color, Pitch, Warble, Light and Cord/Lanyard Combinations

60

| | 72 Whistle 1 | 74 Whistle 2 | 76 Whistle 3 | 78 Whistle 4 | 80 Whistle 5 |
|---|---|---|---|---|---|
| 62 Color | Color 1 | Color 2 | Color 3 | Color 4 | Color 5 |
| 64 Pitch | Pitch 1 | Pitch 2 | Pitch 3 | Pitch 4–5 | Pitch 6–7 |
| 66 Warble | Warble 1 | Warble 2 | Warble 3 | Warble 4 | Warble 5 |
| 68 Light | Frequency 1 | Frequency 2 | Frequency 3 | Frequency 4 | Frequency 5 |
| 70 Cord | Color 1 | Color 2 | Color 3 | Color 4 | Color 5 |

Related U.S. Application Data

(60) Provisional application No. 61/613,522, filed on Mar. 21, 2012.

(51) Int. Cl.
*A63B 71/02* (2006.01)
*G10K 5/00* (2006.01)

(58) Field of Classification Search
USPC ..... 116/137 R; 446/204, 205, 206
See application file for complete search history.

(56) References Cited

U.S. PATENT DOCUMENTS

| | | | | |
|---|---|---|---|---|
| 3,900,196 | A | 8/1975 | Suttner | |
| 4,280,299 | A | 7/1981 | Oka | |
| 4,314,316 | A | 2/1982 | Gertler et al. | |
| 4,821,670 | A | 4/1989 | Foxcroft et al. | |
| 5,086,726 | A | 2/1992 | Sharp | |
| 5,113,784 | A | 5/1992 | Forselius | |
| 5,495,820 | A | 3/1996 | Seron | |
| 5,507,246 | A | 4/1996 | Rand, Jr. | |
| 5,826,534 | A | 10/1998 | Huang | |
| 6,181,236 | B1 * | 1/2001 | Schneider, Jr. | G08B 1/08 340/323 R |
| 6,975,213 | B2 | 12/2005 | Wang | |
| 7,173,533 | B1 * | 2/2007 | Beron | G08B 1/08 340/4.12 |
| 8,382,549 | B2 | 2/2013 | Shishido | |
| 9,940,918 | B2 * | 4/2018 | Ellingson | G10K 5/00 |
| 2005/0068158 | A1 | 3/2005 | Wang | |
| 2005/0162257 | A1 | 7/2005 | Gonzalez | |
| 2006/0171092 | A1 | 8/2006 | Corcoran et al. | |
| 2006/0180073 | A1 * | 8/2006 | Nakamoto | G10K 5/00 116/200 |
| 2010/0261403 | A1 | 10/2010 | Shishido | |
| 2012/0137956 | A1 | 6/2012 | Cheng | |
| 2017/0069181 | A1 * | 3/2017 | Nesemeier et al. | G06F 21/62 |

FOREIGN PATENT DOCUMENTS

| | | | | |
|---|---|---|---|---|
| WO | WO03070336 | A1 | 8/2003 | |
| WO | WO 03107324 | A1 * | 12/2003 | G10K 5/04 |

OTHER PUBLICATIONS

Internet search via Google for "referee whistle kit" dated Apr. 11, 2017, 2 pages.
Internet search via Google for "sport whistle kits" dated Apr. 11, 2017, 2 pages.
Fox 40 international, "Fox40 3-Pack", whistle kit having 3 different whistles, date printed Apr. 11, 2017, 1 page.
Internet Archive Wayback Machine search, Fox 40 International, Products at a Glance, dated Feb. 5, 2012, 4 pages.

* cited by examiner

Packaged whistle set for tournament play identified for pitch/warble variation by number Table 1: Example of Differentiated Whistle Set with unique Color, Pitch, Warble, Light and Cord/Lanyard Combinations

60

| | 72 Whistle 1 | 74 Whistle 2 | 76 Whistle 3 | 78 Whistle 4 | 80 Whistle 5 |
|---|---|---|---|---|---|
| 62 Color | Color 1 | Color 2 | Color 3 | Color 4 | Color 5 |
| 64 Pitch | Pitch 1 | Pitch 2 | Pitch 3 | Pitch 4–5 | Pitch 6–7 |
| 66 Warble | Warble 1 | Warble 2 | Warble 3 | Warble 4 | Warble 5 |
| 68 Light | Frequency 1 | Frequency 2 | Frequency 3 | Frequency 4 | Frequency 5 |
| 70 Cord | Color 1 | Color 2 | Color 3 | Color 4 | Color 5 |

FIG.6

TOOT SUITE WHISTLE PACK

CROSS-REFERENCE TO RELATED APPLICATIONS

This application is a continuation of U.S. patent application Ser. No. 13/848,712, filed Mar. 21, 2013, which claims the benefit of U.S. Provisional Patent Application No. 61/613,522, filed Mar. 21, 2012, the disclosures of which are expressly incorporated herein by reference thereto.

FIELD OF THE INVENTION

The invention relates generally to sporting goods and methods, and particularly relates to sporting goods and methods relating to the sports having referees.

BACKGROUND

A highlight of team sports such as soccer, lacrosse and volleyball is playing an officiated game against another team. Typically, each game has its own head referee ("ref"), who may officiate the game by, inter alta, blowing a whistle. For example, a soccer referee may blow a whistle to commence or to stop play because, for example, play has crossed the boundaries of the field, a foul has been committed, or a successful goal has been recorded.

When only one game is being played with only one referee operating a whistle, the players in that game know to stop play and to whom to look for direction when they hear the whistle. But problems often arise when more than one game is being played in close proximity to one or more other games. Sports tournaments often run concurrent games across adjacent fields, at least in preliminary rounds. To scale the game for younger players, 2-3 pitches are typically created from a single adult-sized playing field. Generally, the games being played at the same time are well within hearing distance of each other. Each game in the tournament is assigned a unique head referee. At such tournaments, all of the refs typically use the same type of whistle (pitch, warble and color) to officiate the games. Generally, these same types of whistles sound very much the same when a whistle is blown by a referee.

At such a tournament, the players from one game may hear a whistle and believe it was their ref who blew it. But they may have heard a whistle blown by another ref officiating at another, albeit nearby, game. In response, the players who heard the whistle from an adjacent game may mistakenly stop play causing confusion and possibly giving advantage to the other team. Even if the players are confused for only moments by the whistle blown by a ref from a nearby game, such confusion may be the cause of injury as one player believes play has stopped and lowers his or her expectation of contact with a competing player. Thus, the playing fields in close proximity can become dangerous when players easily mistake a nearby whistle as an official whistle for their game.

FIG. 1 graphically illustrates the confusion a player on field 2 may experience when a referee on field 1 blows a whistle.

The problems of players mistaking a whistle from a nearby game for their own official's whistle are not limited to single refereed tournament games. A game between two teams in other sports may involve more than one referee with a whistle. Again, each referee in the game is likely to have the same whistle which sounds the same as each other referee's whistle in the game. When a football referee blows his or her whistle, the players have seconds to reset and run the next play. In lightening quick play during the final minutes of a game, as well as at other times, players can be assisted by knowing that the play has been called dead by either the head referee, the umpire the head linesmen, field, side or back judges. Linesmen, typically locked up with defensive players and unable to see the infraction or its location on the field can be confused about where the new line of scrimmage will be. This confusion can cost the team valuable time. For an offense, it may limit the number of plays it can conduct in the remaining time on the clock. For defenses, it can help speed player substitutions and readiness for play. For coaches and commentators, the mere blowing of a whistle for a foul does not assist them in recognizing what the call may be for. In the world of professional football, a plethora of technology and staff can overcome these delays. However, most amateur level games do not have the benefit of either.

Another time when confusion may occur about who blew a whistle is during sports practice. During a practice, different groups of a team may be practicing with respectively different coaches on the same playing field. During a practice, more than one coach may be drilling or scrimmaging their players in the same general area. Practices generally involve significantly more whistle blowing as a means of communication than actual competitive play. At a practice, whistles may be blown by one or more coaches thereby communicating to the players that they should direct their attention to the coaches for additional instruction. The tweeting of multiple whistles by coaches in close proximity to each other can significantly diminish the value of the drills and unnecessarily interrupt scrimmaging.

The confusion that may occur during games or tournaments by referees who all use the same sounding whistle is even further exacerbated when younger players are involved. As noted previously, for the purpose of using existing adult-sized purposebuilt soccer fields, 2-3 scaled-down pitches may be lined within a single field. So, for example, when a number of soccer games involving younger players are occurring on a Saturday morning in the same general area, the chances that a player from one game may be confused by a whistle blown by a ref from another game are increased. The playing fields are smaller so it is more likely that players from one game would interpret a whistle from another game as their own or at least be confused by the whistle. Moreover, the younger players may be more confused by ref whistles, in general, than older players who play with their heads up and regularly watch the referees and their positioning.

There is yet another point to consider relating to the issue of official whistle blowing in sports games. In modern officiating of sports like football and basketball where multiple whistling referees are simultaneously on the same field or court, the ability of the head referee to understand which referee stopped play without looking for a visual clue can dramatically reduce time between plays. This could alternatively be accomplished with expensive radio systems for the entire referee squad, but few amateur events can afford such an expense. Post-game video/audio review of referee performance after a game or match can also be enhanced by knowing who blew the whistle. As most referees leave their whistles in their mouths during play, it is almost impossible to look at video of a game and tell which referee stopped play and jurisdictionally whether this stoppage was within their scope of responsibility. Such reviews can lead to improvements in squad assignments, positioning and efficiency during the game.

For additional background, the following materials are incorporated by reference: U.S. Pat. No. 945,311 to Fendrich, U.S. Pat. No. 1,930,504 to Benjafield, and U.S. Pat. No. 4,314,316 to Gertler.

SUMMARY

Generally stated, the invention relates to sporting goods and methods, and particularly relates to sporting goods and methods relating to the sports having referees. More particularly, the inventions relates to sets of whistles or kits and methods of using them.

The term "whistle" is used herein with respect to its conventional meaning of an instrument for producing a whistling sound(s) by a person using his or her breath. A whistle according to the invention may be any type of whistle including a small wooden or tin tube, a pipe, or a similar device with an air chamber containing a small ball that osciallates when air is forced through an opening producing a sound. But the invention should not be limited to the conventional meaning of a "whistle". The term "whistle" is used herein to refer to any device that may be caused to emit a sound or noise and may be used in accordance with the invention.

An embodiment of the invention includes a set of two or more whistles. Each whistle of the set has a respectively different sound characteristic from each other whistle of the set. A sound emitted from a whistle of the set sounds differently from other sounds emitted respectively from other whistles of the set. This first embodiment may be modified into a second embodiment where in addition to each whistle in the set sounding differently, each whistle of the set has a respectively different appearance characteristic from each other whistle of the set of whistles. Appearance characteristics may include, but not be limited to: color, numbering, design, light up features, size, or shape.

The first embodiment may be modified into a third embodiment where in addition to each whistle in the set sounding differently, each whistle of the set has a respectively different lanyard. In other words, the lanyards distinguish the whistles of the set from each other in appearance. The first embodiment may be modified into a fourth embodiment where in addition to each whistle in the set sounding differently, each whistle of the set has a respectively different mouthpiece. In other words, the mouthpieces distinguish the whistles of the set from each other in appearance.

Another embodiment of the invention presents a set of two or more whistles. Each whistle of the set has a sound characteristic in common with each other whistle in the set. Sound characteristics may include, but should not be limited to: pitch, quality, loudness, or duration. As noted, in this embodiment, each whistle has a sound characteristic in common with each other whistle in the set. Yet, each whistle of the set has a respectively different value of the common sound characteristic from each other whistle of the set. A sound emitted from a whistle of the set sounds differently from other sounds emitted respectively from other whistles of the set based on the sound having a different value of the common sound characteristic from respective other values of the sound characteristic common to the other whistles of In another embodiment, in addition to sounding differently from each other, (by having different sound characteristics or having different values of a common sound characteristic), each whistle in a kit may have an appearance characteristic in common with each other whistle of the set of whistles. As noted, appearance characteristics may include, but not limited to: color, numbering, design, light up feature(s), size, and/or shape. In this embodiment, each whistle of the set of whistles has a respectively different value of the common appearance characteristic from each other whistle of the set of whistles.

An additional embodiment of the invention is a kit that includes a housing for removably storing two or more whistles. Each whistle in the kit sounds differently from each other whistle when a whistle is blown. Also, each whistle in the kit may be different in appearance from each other whistle.

The invention such as may be embodied as described variously herein may provide many benefits to sports players and the referees that officiate the game. Among the possible advantages are:

- Minimizing player confusion upon stoppage of a game;
- Improving player safety;
- Speeding the non-play processing and officiating of the game;
- Providing a low cost and simple solution that requires little/no education of the players;
- Enhancing of the existing system used by refs;
- Enhancing existing ref performance review systems;
- Offering a great gift idea for volunteer/paid refs;
- Providing an opportunity for whistle suppliers to sell multiple whistles per sale;
- Providing the opportunity for whistle suppliers to sell replacement whistles for sets; and
- Providing the opportunity for whistle suppliers to personalize whistles and containers for a premium.

The invention is described herein as being used with specific elements and features, but should not be limited to the particular examples given. The invention may be used in other circumstances and/or with other elements or features. Exemplary or examples of embodiments according to the invention have been summarized above. Many more are possible; the inventions are not to be limited to these examples. Other features and advantages of the inventions may be more clearly understood and appreciated from a review of the following detailed description and by reference to the appended drawings and claims.

BRIEF DESCRIPTION OF THE DRAWINGS

FIG. 6 is a table including an example of a differentiated whistle set with unique color, pitch, warble, light, and cord/lanyard combinations.

DETAILED DESCRIPTION

Figure 1:
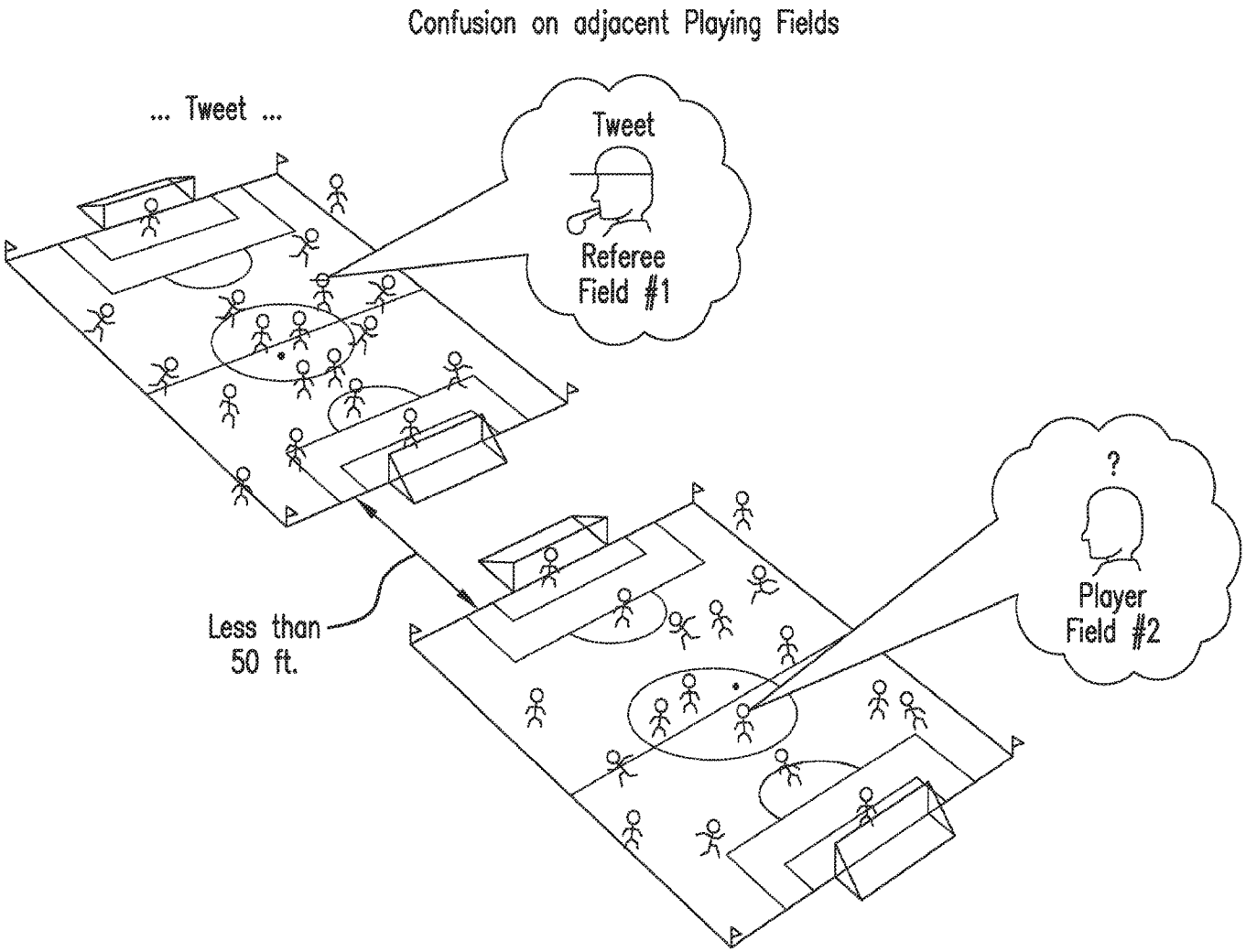
FIG. 1 illustrates the confusion a player on field 2 may experience when a referee on field 1 blows a whistle.

The invention is described herein with reference to exemplary embodiments, alternative embodiments, and also with reference to the attached drawings. The inventions, however, can be embodied in many different forms and carried out in a variety of ways, and should not be construed as limited to the embodiments set forth in this description and/or the drawings. The exemplary embodiments that are described and shown herein are only some of the ways to implement the inventions. Elements and/or actions of the inventions may be assembled, connected, configured, and/or taken in an order different in whole or in part from the descriptions herein.

A purpose of my invention is to help a player and/or ref (especially the head ref) in a game immediately recognize who blew a whistle. Such quick recognition is likely to mitigate problems and confusion created in the circumstances described in the background such as during sports tournaments, during a game with more than one official having a whistle, during practices when different sports teams or different groups of a sports team may be working with different coaches having whistles in relatively close proximity to each other, and/or during games and tournaments involving younger players.

Stated generally, my invention provides a set of whistles. The number of whistles within each set may vary. See below for further explanation about the possible number of whistles in a set. A "set" also may be referred to as a "kit" or "pack".

Within a set of whistles, according to my invention, each whistle may be distinguished from each other whistle. Preferably, a player in a game may distinguish one referee's whistle from that of another referee. Whistles in a set may be made distinguishable from each other in a variety of ways such as by a whistle's sound characteristics and/or its appearance characteristics.

Sound characteristics—A whistle's sound characteristics may include pitch, quality, loudness, and/or duration. Each of the sound characteristics may vary across a spectrum. A particular sound characteristic within its spectrum is identified by its "value" in that spectrum.

Pitch—The sound characteristic of "pitch" also may be referred to as frequency. A pitch of a single frequency is referred to as a "pure tone".

Quality—The sound characteristic of "quality" also may be referred to as tone or timber (timbre) and may include a fundamental tone and overtones. The "quality" characteristic may be defined by reference to vibrato/tremolo values. Vibrato generally refers to the periodic changes in pitch of a tone. Tremolo refers to periodic changes in amplitude. Further, the "quality" characteristic may encompass multi-pitch glide and/or warble.

Loudness—The sound characteristic of "loudness" relates to the physical sensation experienced by a listener when hearing the sound.

Duration—The sound characteristic of "duration" relates to the length of time a sound is heard.

In the exemplary embodiments, generally only the first two sound characteristics are used because they are characteristics inherent to a whistle itself. The other two sound characteristics of a whistle may depend on a user's manner of blowing a whistle rather than just on the whistle itself Nonetheless, the invention may be embodied in a set of whistles where the whistles may be distinguished from each other based on a sound characteristic(s) including loudness and/or duration.

Appearance characteristics—Like sound characteristics, a whistle's appearance characteristics may include color, numbering, design, light up features, and/or size and/or shape.

Whistles within a Set of Whistles May be Distinguished from Each Other by Sound Characteristic(s) and/or Values Thereof By way of further explanation, the reader is provided with the example of a set of whistles according to the invention. In this example, each whistle in the set has its own unique sound compared to the other whistles in the set. In other words, the sound issuing from one particular whistle of a set is different from the sound issuing from each other whistle in the set.

Whistles of a Set Distinguished from Each Other by Differing Values of a Single Characteristic The respective differences in the sounds of whistles in a set may be accomplished in any of a variety of ways. As noted above, the sound of a whistle may have one or more characteristics including pitch, quality, loudness, and/or duration. In this example, the respective differences in the sounds of whistles in a set may be accomplished by varying the value of the sound characteristic of pitch or frequency across the whistles in the set. To put another way, each whistle may be made to sound at its own particular frequency.

As another example, each whistle in a set may emit a sound whose sound characteristic includes a "warble". In this set, each whistle's sound warble is different from each of the other sound warbles by whistles in the set. The differences in "warble" for whistles in a set may be simply accomplished by changing the size/shape of the respective peas used in the whistles of the set. The warble may disrupt a continuous pitch by varying the whistle's pitch, tone/timbre and/or articulation.

Whistles of a Set Distinguished from Each Other by Differing Sound Characteristics Another way to embody the invention is to differentiate whistles in a set from each other by varying the sound characteristics from whistle to whistle. Assume an exemplary a set of whistles having two whistles. One of the two whistles may have a. sound characteristic of only pitch or frequency. The other whistle may have a warble as its quality of sound. Thus, a player may be able to distinguish each whistle based on its different sound characteristic.

Whistles of a Set Distinguished from Each Other in Subsets of Sound Characteristics Another way to embody the invention may be to include whistles in a set where one or more whistles share a common sound characteristic but have respectively different values thereof. The remaining whistles share a different sound characteristic, and also have respectively different values thereof. By way of example, in a set of five whistles, three whistles may each be of a unique pitch. The other two whistles may each have its own warble. Other variations are possible.

Whistles of a Set Distinguished from Each Other in More Than One Way

Advantageously, the invention may be embodied so that a whistle in a set may vary in sound characteristics from one or more other whistles in its set in other ways than described so far. For example, in a set of three whistles, a first whistle may have a single sound characteristic, a second whistle may have two sound characteristics, and a third may have two sound characteristics different at least in one characteristic from the second whistle. The first whistle in this exemplary set may have a high pitch. The second whistle may have a middle level pitch and a slight warble. The third whistle may have a low pitch and a strong warble.

Whistles within a Set of Whistles May be Distinguished from Each Other Based on a Sound Characteristic(s) and an Appearance Characteristic(s)

As noted, the invention relates to a set of whistles that sound differently from each other. The whistles in the set, however, may all look the same. The whistles of a set may be assigned arbitrarily to the people who are going to be using them with the assurance that each whistle, even though it looks like the others in the set, sounds differently.

On the other hand, one or more of the people using the whistles may prefer one of the whistles in the set over the other whistles. There may be no way to tell the difference in the whistles except to blow them. Determining a particular whistle of a set by blowing all of the whistles until the desired whistle is found may not be acceptable to users of the whistles in the set for at least hygienic reasons. Being unable to distinguish the whistles without blowing them may lead to time delays in assigning whistles, in confusion in case the whistles are mixed up, etc.

To overcome the problems associated with whistles in a set which all look the same but sound differently, exemplary embodiments of my invention may differentiate the whistles within a set based on sound characteristic(s) (and/or values thereof) as mentioned above and the characteristic(s) of appearance of a whistle. The appearance characteristic of a whistle is the way it looks. Generally, any of the appearance characteristics, singly or in combination, described below may be applied to one or more of the sound characteristics or combinations thereof described above in exemplary embodiments of the invention.

Appearance characteristics of a whistle in a set may include, but are not limited to color, number, light emitting, size, and/or shape. An appearance characteristic may be a whistle's decoration or marking. For example, a team logo on a whistle is an appearance characteristic. An appearance characteristic of a whistle may have one or more features. For example, an appearance characteristic such as light emitting may include features, but not be limited to, color, multi-color, brightness, flashing rate, and/or lens refraction/reflection. Each of these features may have a value.

A Set of Whistles May Have the Same Appearance Characteristic but Differing Respective Values of That Characteristic An exemplary embodiment of the invention may include any one of the set of whistles described above wherein each whistle of the set sounds differently from each other. To tell the whistles of the set easily apart without resort to blowing the whistles, the whistles may share an appearance characteristic, but have differing values thereof. The set of whistles, by way of example, may share the appearance characteristic of color. But each whistle in the set may be a different color to distinguish it from the other whistles of the set. Another example is that of numbering the whistles within the set. Each whistle may have a number indicator different from each other whistle.

A Set of Whistles May Have Two or More Common Appearance Characteristics but Differing Respective Values of Those Characteristics Another exemplary embodiment differentiates the whistles within a set based on two or more characteristics of appearance. For example, each whistle in a set may be a different color and bear a different number from each other whistle in the set.

Whistles of a Set Distinguished from Each Other in Subsets of Appearance Characteristics As with the sound characteristic distinguishers, appearance characteristic(s) and values thereof may distinguish subsets of whistles within a set of whistles. For example, assume a set of 5 whistles. The first subset of two whistles may share the color characteristic of appearance, but each whistle may be a different color. The second subset of three whistles may share the numbering characteristic of appearance, but each whistle may be a different number. By appearance, each of the whistles is readily distinguishable for each other.

Other combinations of one or more appearance characteristics, and/or values are possible with respect to embodying the invention.

Light Emitting as an Appearance Characteristic

The appearance characteristic of "light emitting" has been mentioned. For example, a light such as an electronic light may be emitted by a whistle when it is blown. This is referred to herein as the "light emitting" appearance characteristic. This characteristic may have features such as color, flashing, etc. Each of those features may have values such as various colors for the color feature, flashing rates for the flashing feature, etc.

Players who are deaf already rely on emission of a light by a whistle when it is blown so that they may know a whistle has been blown. Whistles within a set of whistles may be made to emit their own respective unique lights. The uniqueness of the light may be one or more of the following features: color, multi-color, brightness, flashing rate and/or lens refraction/reflection. Other features will be known to those skilled in the art.

Advantageously, players and referees may easily distinguish whistles within a set based on their unique appearance characteristic, and features and/or values thereof. The differences in the appearance characteristics may be so strong as to be readily visible on the playing field. The differences in the appearance characteristics of whistles in a set, however, are particularly useful when assigning whistles to those who are to use them within close proximity with each other. A referee knows his or her whistle will sound differently from referees in adjacent playing fields if the appearance characteristic (based on different features and/or values) of their whistles are different from each other.

Accessories

Use of a whistle may be facilitated by accessories. For example, a whistle may be more easily carried by being strung on a device so that the whistle may hang around the user's neck. The device may be a chain, string, necklace, lanyard, and/or the like. Another accessory that may facilitate the use of a whistle is a mouthpiece that may be attached to the part of the whistle that is blown by the user.

An exemplary embodiment of the invention incorporates one or more types of accessories into a set of whistles. If the set of whistles incorporates appearance characteristic(s) to distinguish the whistles in the set by looking at them, the accessories used with the set may also incorporate one or more of those appearance characteristics. Assume, for example, whistles of a set according to the invention may be differentiated. from each by the two appearance characteristics of number and of color. A type of accessory used with that set of whistles may be decorated with either appearance characteristic or both characteristics. For example, if a lanyard is provided for each of the whistles in the set of whistles differentiated by number and color, then the lanyard for a particular whistle may be the same color as the whistle.

Boxed Set or Kit of Whistles

An exemplary embodiment houses a set of whistles in a container such as a box. Advantageously, a user may be assured that the whistles within the container may be distinguished from each other at least in the way they sound.

An exemplary embodiment of the inventions may provide a set of whistles and/or accessories for presentation to and/or use by the referees of a particular game to be played such as a game in a tournament. The set of whistles may be boxed or otherwise organized and/or presented. The box or other container holding the set of whistles may include information about the game and/or tournament.

A set of whistles such as may be put together for a special game or a tournament may be augmented with other related elements. For example, the set of whistles may or may not include coordinated accessories to the whistles such as respectively matching lanyards, mouth guards, etc. The container provided for the set of whistles may be configured for convenient storage and/or possible display. The tournament whistle sets (each whistle or the container) may be embossed or branded with a specific tournament, event and/or match/game for gifting, memorabilia, or other purposes.

Figure 2:
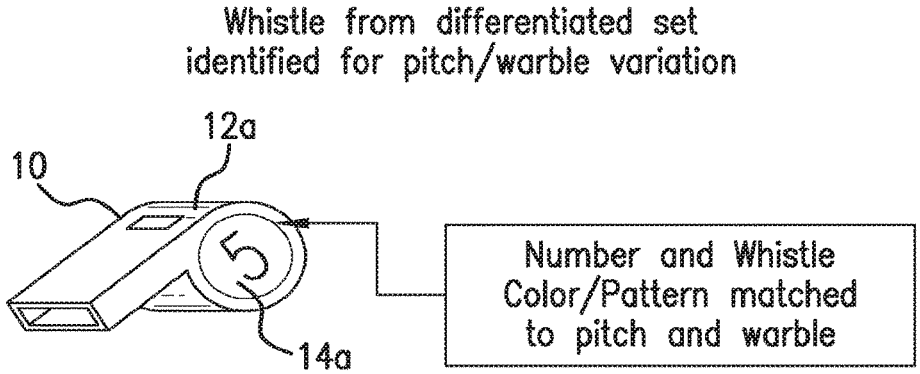
FIG. 2 illustrates an example of a whistle that may be used with an exemplary embodiment of the invention.

FIG. 2 illustrates an example of a whistle 10 that may be used with an exemplary embodiment of the invention. This whistle 10 is part of a set of whistles 20 (see FIG. 2) in which each of the whistles sounds differently from the others based on the pitch/warble variation. The whistle 10 includes two appearance characteristics. The shading 12*a* on the whistle 10 indicates it is of a particular color/pattern. The number "5" 14*a* on the whistle 10 indicates it has been assigned and marked with the number "5".

Figure 3:
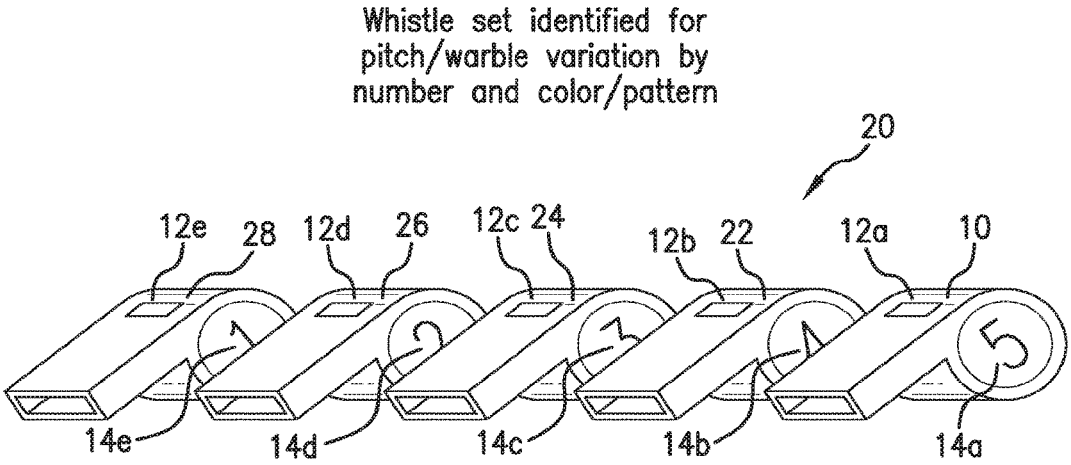
FIG. 3 illustrates an example of a set of whistles according to the invention.

FIG. 3 illustrates an example of a set of whistles 16 according to the invention and identified for pitch/warble variation by number and color pattern. This set 16 includes five whistles 10, 22, 24, 26, and 28. Each whistle 10, 22, 24, 26, and 28 includes two appearance characteristics. The respectively different shading 12*a-e* on each of the whistles 10, 22, 24, 26, and 28 indicates that each of the whistles 10, 22, 24, 26, and 28 is of a particular color/pattern from the others. The respective numbers 11.4*a-e* on the whistles 10, 22, 24, 26, and 28 indicate they each have been assigned their own number.

Figure 4:
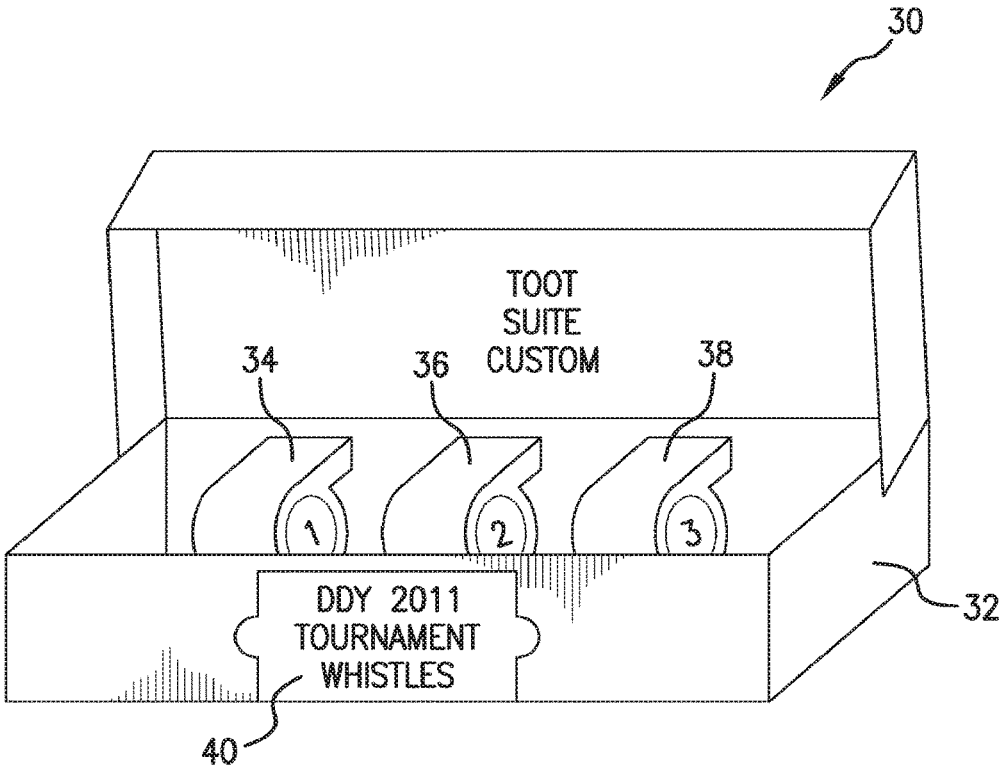
FIG. 4 illustrates an example of a kit including a set of whistles according to the invention.

FIG. 4 illustrates an example of a kit 30 including a box 32 removably housing a set of whistles 34, 36, and 38 according to the invention. The whistles 34, 36, and 38 differ from each other in sound by pitch/warble variation. The whistles 34, 36, and 38 differ from each other in appearance by being numbered differently. The kit 30 also includes a small plaque 40 attached to the box 32. The plaque 40 includes information about a particular tournament. Of course, the plaque 40 may be made to include additional or other information.

Figure 5:
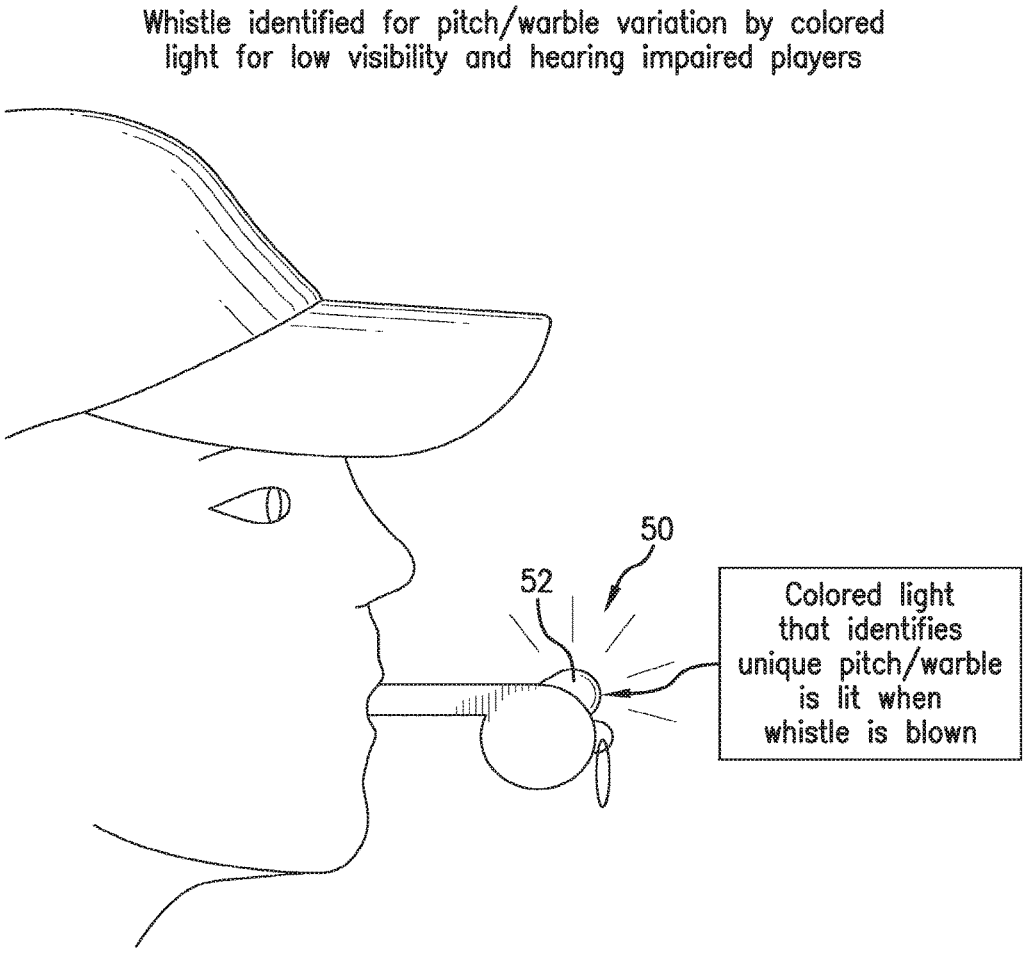
FIG. 5 illustrates an example of a whistle that may be used with an exemplary embodiment of the invention.

FIG. 5 illustrates an example of a whistle 50 that may be used with an exemplary embodiment of the invention. The whistle 50 is identified for sound regarding the pitch/warble variation by a color light 52 that appears when the whistle 50 is blown. The appearance of a colored light when a whistle is blown is particular advantageous in low visibility conditions and/or for players who are hearing impaired.

FIG. 6 is a table 60 showing rows of five characteristics (color 62, pitch 64, warble 66, light 68, and cord 70) that may be varied with respect to a set of five whistles 72, 74, 76, 78, 70 so each whistle has unique color 62, pitch 64, warble 66, light 68, and cord 70 combination.

Conclusion

The exemplary embodiments of the present inventions were chosen and described above in order to explain the principles of the invention and their practical applications so as to enable others skilled in the art to utilize the inventions including various embodiments and various modifications as are suited to the particular uses contemplated. The examples provided herein are not intended as limitations of the present invention. Other embodiments will suggest themselves to those skilled in the art. Therefore, the scope of the present invention is to be limited only by the claims below.

I claim:

1. A set of two or more whistles, comprising:

each whistle of the set of whistles having a respectively different value of a first signal characteristic from each other whistle of the set of whistles;

each whistle of the set of whistles having a second signal characteristic in common with each other whistle of the set of whistles; and each whistle of the set of whistles having a respectively different value of the second signal characteristic from each other whistle of the set of whistles, wherein the first signal characteristic and the second signal characteristic are emitted when the whistle is blown.

2. The set of two or more whistles of claim 1, wherein one or both of the first signal characteristic and the second signal characteristic is received to identify the whistle blown.

3. The set of two or more whistles of claim 1, wherein one or both of the first signal characteristic and the second signal characteristic is received to locate the whistle blown.

4. The set of two or more whistles of claim 1, wherein one or both of the first signal characteristic and the second signal characteristic is received to determine a time the whistle was blown.

5. The set of two or more whistles of claim 1, wherein one or both of the first signal characteristic and the second signal characteristic is received to synchronize one or both of an audio and a video stream.

6. The set of two or more whistles of claim 1, wherein the first signal characteristic comprises a sound characteristic.

7. The set of two or more whistles of claim 6, wherein the sound characteristic comprises one or more of pitch, quality, loudness, and duration.

8. The set of two or more whistles of claim 1, wherein the second signal characteristic comprises an electromagnetic signal.

9. The set of two or more whistles of claim 8, wherein the second signal characteristic comprises one or more of frequency, wavelength, intensity, pattern, and duration, of the electromagnetic signal.

10. The set of two or more whistles of claim 1, wherein the second signal characteristic comprises light emitting characteristic, the light emitting characteristic comprising one or more of color, flashing, and brightness.

* * * * *